United States Patent [19]

Amundsen

[11] 4,318,433

[45] Mar. 9, 1982

[54] INCISOR ROLL

[75] Inventor: Ralph D. Amundsen, La Crosse, Wis.

[73] Assignee: Webster Wood Preserving Company, Wayzata, Minn.

[21] Appl. No.: 153,179

[22] Filed: May 27, 1980

[51] Int. Cl.[3] ..... B27E 9/04

[52] U.S. Cl. ..... 144/2 J; 144/230; 144/320 R; 407/43

[58] Field of Search ..... 144/2 J, 320, 230; 83/117, 349; 407/31, 43, 46, 47, 49, 51, 52

[56] References Cited

U.S. PATENT DOCUMENTS

| | | | |
|---|---|---|---|
| 2,645,003 | 7/1953 | Thompson et al. | 407/46 |
| 2,930,110 | 3/1960 | Glodde | 407/46 |
| 3,059,676 | 10/1962 | Kiser | 144/230 |
| 3,125,141 | 3/1964 | Best et al. | 144/2 J |
| 3,200,474 | 8/1965 | Kralowetz | 407/49 |
| 3,574,251 | 4/1971 | Corti | 407/49 |
| 3,595,117 | 7/1971 | Grettve | 83/349 |
| 3,709,271 | 1/1973 | Flory | 144/208 |
| 3,929,044 | 12/1975 | Beauchet | 407/47 |
| 3,954,034 | 5/1976 | Broderick | 83/117 |
| 4,137,956 | 2/1979 | Toberg | 144/2 J |

*Primary Examiner*—W. D. Bray

*Attorney, Agent, or Firm*—James R. Haller

[57] ABSTRACT

A wood incisor for perforating the surface of lumber. The incisor includes a roll having a plurality of spaced sockets in its circumferential surface. Incisor teeth are received in the sockets and are clamped in the sockets by means of camming elements.

8 Claims, 6 Drawing Figures

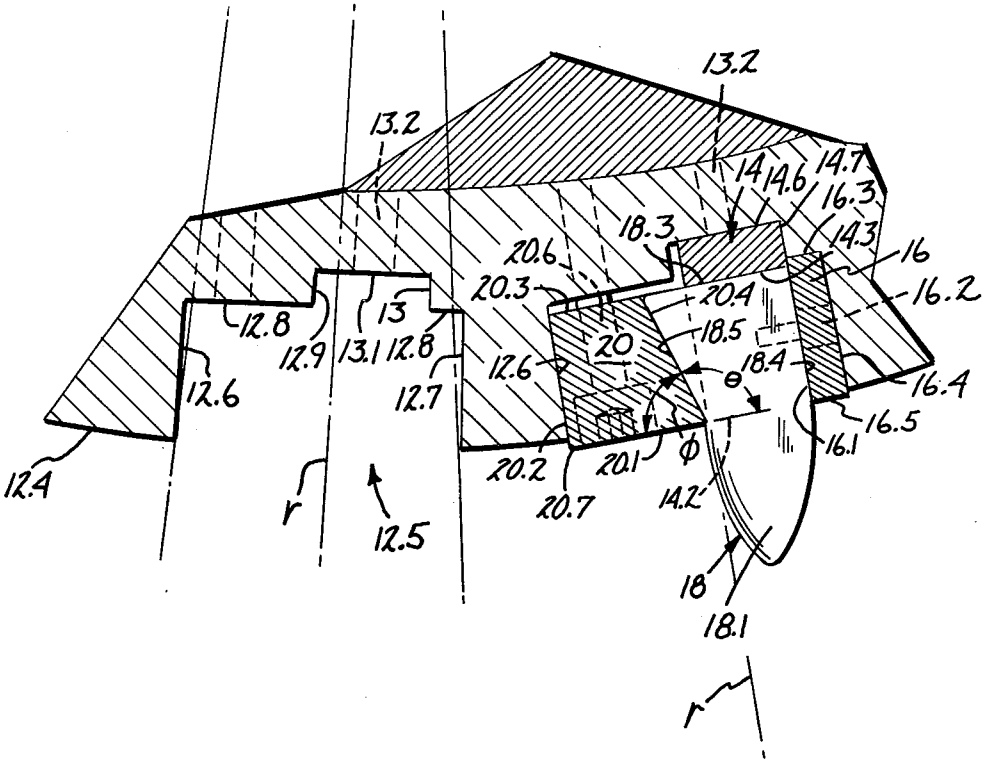
Fig. 4
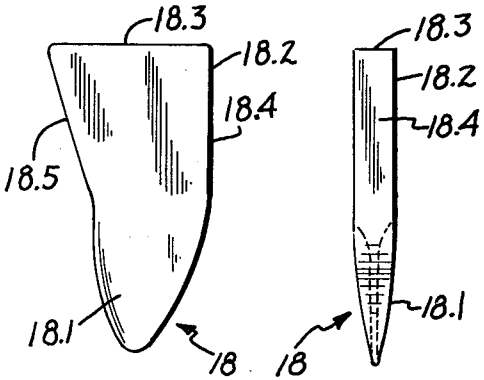
Fig. 5A
Fig. 5B

INCISOR ROLL

TECHNICAL FIELD

This invention relates generally to incisor roll devices used to make incisions in lumber for the purpose of improving the penetration of a preservative into the lumber.

BACKGROUND ART

The useful life of lumber intended for use in contact with the soil may be increased by impregnating the lumber with a preservative such as creosote or an oil-creosote mixture or the like. Railroad ties, for example, may be impregnated by treating the tie surfaces with a hot pressurized mixture of oil and creosote, the mixture penetrating for a distance into the ties. Penetration may be improved by forming incisions in the surfaces of the railroad ties before the impregnation step. Incisions are commonly made by passing the lumber through rollers having teeth extending from their surfaces, the teeth penetrating into the lumber parallel to its grain. Reference is made to U.S. Pat. Nos. 3,124,141, 3,709,271 and 4,137,956 for various devices for incising lumber in this manner.

The incisor teeth protruding from rollers such as those described in U.S. Pat. No. 3,125,141, are often broken during the incising operation because of the large forces involved. The teeth of incisor rolls such as those shown in U.S. Pat. No. 3,709,271 are provided with threaded shanks, and it would appear that such teeth can loosen or turn sidways out of alignment with the grain of the lumber.

The replacement of teeth in incisor rollers of the prior art has becomes a significant problem. For example, with the device of U.S. Pat. No. 3,125,141, one must remove the teeth and spacers from a channel formed in the roller until the broken tooth is able to be removed, following which a new tooth is inserted and the spacers and teeth are replaced in the channel. A threaded bolt urges the teeth and spacers together in place. In U.S. Pat. No. 3,709,271, which provides teeth with threaded shanks, tooth breakage at the shank causes the threaded shank to remain in its threaded socket in the roll, and removal of the shank may pose a difficult problem. With the roller of U.S. Pat. No. 4,137,956, replacement of a broken tooth entails removal of toothed rings and spacers from the circumference of the roller until the ring with the broken tooth is found, following which that entire ring must be replaced and the toothed rings and spacer rings must thereafter be carefully replaced on the roll.

DISCLOSURE OF INVENTION

The instant invention provides an incisor roll having generally radially outwardly extending teeth that are rigidly held in place during an incising operation to reduce tooth breakage. Moreover, a broken tooth may be replaced with a new tooth without the necessity of removing or disturbing teeth from the roller other than the broken tooth. The incisor roll includes a rotatable cylinder having a pluraity of spaced sockets in its circumferential surface, and teeth are received in the sockets and protrude generally radially outwardly of the cylinder in position to cut into a workpiece such as lumber engaged by the cylinder as the latter rotates. Locking means are provided to lock the teeth within the sockets. The locking means comprises camming means removably attached to the cylinder, the camming means having an exterior surface engageable with the workpiece as the latter is transported past and in engagement with the cylinder to urge the camming means inwardly of the cylinder, and a tooth engaging surface engageable with a plurality of said teeth and oriented to urge the latter into fixed seating position in the sockets as the camming means is urged inwardly of the cylinder. Removal of the camming means permits any tooth previously held by it to be removed and replaced without disturbing neighboring teeth.

BRIEF DESCRIPTION OF THE DRAWINGS

FIG. 4 is a broken-away, cross-sectional view of the roller of FIG. 1 showing the roller with and without tooth-supporting elements;

FIG. 5A is a top view of a tooth employed in the roller of the invention; and FIG. 5B is a side view of the tooth shown in FIG. 5A.

BEST MODE FOR CARRYING OUT THE INVENTION

Figure 1:
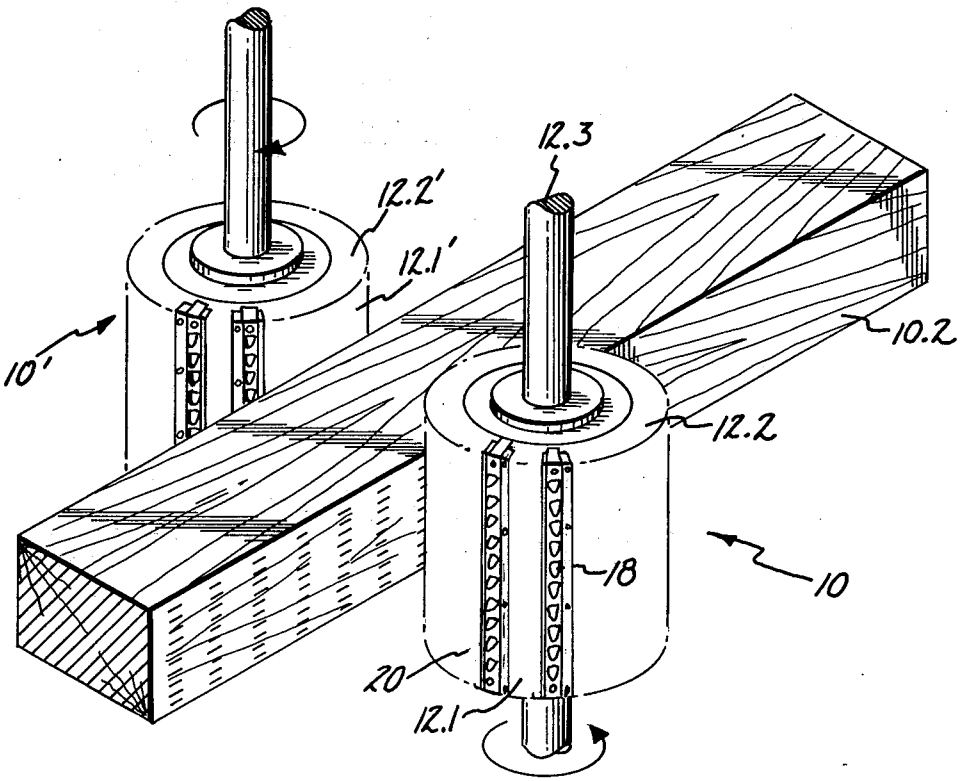
FIG. 1 is a perspective, diagrammatic view of a roller of the invention located with respect to a coacting roller, and a railroad tie to be incised is shown passing between the rollers.

The incisor roller of the invention is designated generally as 10 in FIG. 1 and includes a right cylinder which may be made of one or more concentric cylindrical shells. At least the outer shell, or single shell if but one shell is employed, (12.1), is of strong, hard material such as steel. The ends of the shell are capped, as shown at 12.2 in FIG. 1, the caps being bolted or welded or both to the shell and the caps including means for receiving a drive shaft (12.3). In the process of forming incisions in a railroad tie or other workpiece, the incisor roller of the invention is employed with an indentical, opposed roller designated 10' in FIG. 1. The railroad tie (10.2) or other item of lumber passes between the rollers. By means of springs or pneumatic pressure systems, the rollers may be urged together or apart as pieces of lumber of slightly different dimensions are passed between them. Such systems are known to the art and need not be described here. Generally, only one of the rollers (10) need be driven, the other roller being an idler roller which is caused to rotate about its axis by the passage of lumber. FIG. 1 shows only rollers at the sides of the railroad tie (10.2); it will be understood that substantially identical rollers are also provided above and below the tie so that all four of the longitudinal surfaces of the tie are provided with incisions.

Figure 2:
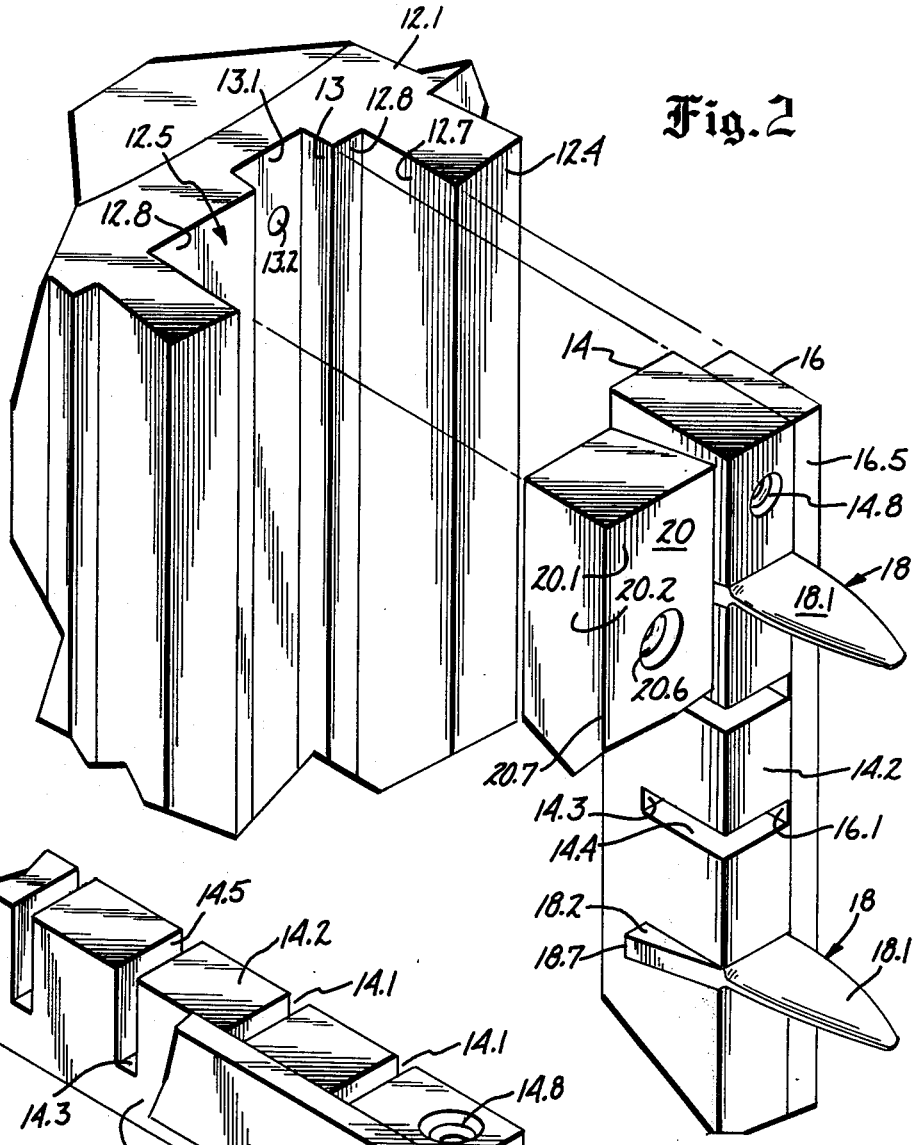
FIG. 2 is a broken-away, exploded view of a portion of the roller of FIG. 1, some of the teeth being removed for purposes of clarity.

Referring to FIG. 4, outer, circumferential surface (12.4) of the shell (12.1) is provided with a series of slots designated generally in FIG. 4 as 12.5, the slots being equally spaced about the circumference of the shell and extending parallel to the axis of the roller. With particular reference to FIGS. 2 and 4, the slots are formed with generally parallel side walls (12.6, 12.7), such walls being substantially parallel to a radius "r" of the shell that passes generally midway between the side walls. The slot has a generally flat bottom or floor (12.8) disposed at right angles with the walls (12.6, 12.7), and a portion of the floor (12.8) is provided with a further recess having side walls (12.9, 13) and a floor (13.1) that are respectively parallel to the side walls (12.6, 12.7) and floor (12.8). The slot in FIG. 4 adjacent the slot bearing identifying numerals is identical to the latter slot, and need not be renumbered.

A tooth-receiving bar is designated generally as 14 in the drawing, and comprises a generally rectangular bar having a length approximately equal to the length of the cylindrical shell (12.1). The width of the bar is slightly less than the width of the recess defined by the walls (12.9, 13, 13.1), as shown best in FIG. 4. The depth of the bar is approximately equal to the distance between the floor (13.1) of the slot and the outer circumference (12.4) of the shell, measured along the radius "r" in FIG. 4. The tooth-receiving slots (14.1) opening through its forward surface (14.2), the slots extending generally at right angles to the length of the bar and terminating in slot floors (14.3). The opposing walls (14.4, 14.5) (FIGS. 2 and 3) of the slots are generally parallel and are separated by the approximate thickness of a tooth to be received therein, typically approximately 0.25 inches (about 6.35 mm.).

Figure 3:
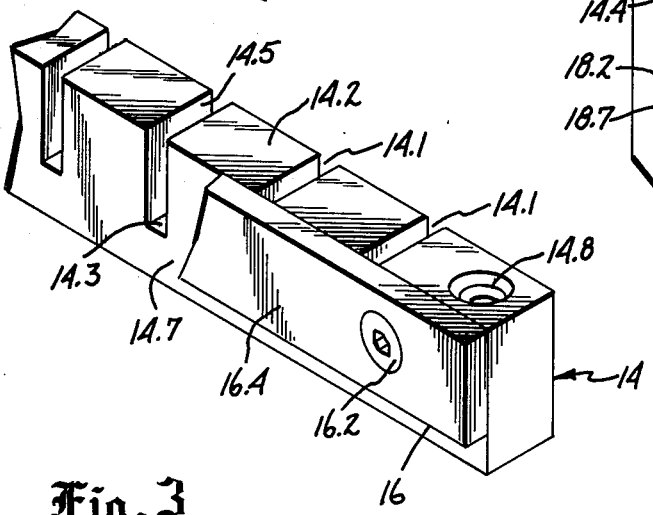
FIG. 3 is a broken-away, perspective view of a portion of the roller shown in FIG. 2.

Extending along one side of the tooth-receiving bar (14) is a wear bar (16) of approximately the same length as the tooth-receiving bar (14). The wear bar (16) is desirably bolted, as by bolts (16.2), to the tooth-receiving bar (14). The wear bar (16) is generally rectangular in cross-section, and has a width approximately equal to the distance between the side walls (12.7 and 13) of the slot (12.5). With reference to FIGS. 2 and 3, the wear bar (16) covers the openings of the tooth-receiving slots (14.1) along one side of the tooth-receiving bar (14), the inner surface (16.1) of the wear bar coacting with the opposed surfaces (14.4, 14.5) and floor (14.3) of the tooth-receiving slots to define a socket typifying socket means for the reception of teeth.

The combined slotted bar (14) and wear bar (16) are received as a unit in the slot (12.5), as shown best in FIG. 4, the rearward wall (14.6) being received against the floor (13.1) of the slot and the side wall (14.7) of the slotted bar abutting the side wall (13) of the slot. The outer elongated surfaces (16.3 and 16.4) of the wear bar abut the surfaces (12.8 and 12.7, respectively), of the slot (12.5). The forward or outer surface (16.5) of the wear bar desirably is coextensive with the outer surface (14.2) of the slotted, tooth-receiving bar (14). The latter bar is then affixed to the shell by means of bolts passing through the bolt holes (14.8, 13.2) formed respectively in the tooth-receiving bar and the shell (12.1).

A typical tooth is depicted in FIGS. 5A and 5B (as 18), the tooth having a blade portion (18.1) and a base portion (18.2). The base portion is provided with rear and side walls (18.3, 18.4) generally at right angles to engage the rear surface (14.3) of the slotted bar (14) and the inner surface (16.1) of the wear bar, respectively, as shown in FIG. 4. It will be evident that the bottom tooth shown in FIG. 2 can be easily removed from the slot (14.1) by merely pulling the tooth forwardly out of the slot; that is, the socket represented by the slot (14.1), in the absence of a locking bar (20) (discussed below), is free of obstacles interfering with withdrawal of a tooth from the socket. The side (18.5) of the base of the tooth that is opposite side 18.4 forms a bearing surface at an obtuse angle $\theta$ with a plane tangent to the outer circumferential surface of the shell where that side emerges from that circumferential surface, as shown in FIG. 4. The angle $\theta$ is greater than 90° but preferably is less than about 110°. The walls (18.4, 18.5) of the tooth base converge outwardly toward the blade (18.1). Desirably, the side of the tooth base protrudes from the circumference of the shell at the location of the radius "r" as shown in FIG. 4.

As shown best in FIGS. 2 and 4, there is provided a locking bar (20) that is substantially coextensive in length with the tooth-receiving bar (14) and the wear bar (16). The locking bar is best seen in cross-section in FIG. 4, and includes an outwardly facing wall (20.1), a side wall (20.2), an inwardly-facing wall (20.3), and an oblique camming wall (20.4). The walls of the bar are so oriented that the side wall (20.2) is received in sliding surface-to-surface guiding contact with the side wall (12.6) of the slot formed in the shell and lies in a plane forming an acute angle with the plane at the side wall (20.2). The camming wall (20.4) forms an angle $\phi$ with a plane tangent to the outer circumferential surface of the shell, $\phi$ being complementary to the angle $\theta$. In this manner, as the locking bar is inserted inwardly of the slot (12.5) formed in the shell, the side wall (20.2) of the bar slides along the slot wall (12.6), and the camming wall (20.4) of the bar comes into generally surface-to-surface contact with the bearing surfaces forming the side walls (18.5) of the teeth (18) to exert a camming or wedging force against the teeth. It will now be understood that as the locking bar is forced further inwardly, generally radially of the incisor roller, the teeth (18) are pressed more firmly into contact with the floors (14.3) of the slots (14.1) and with the inner surface (16.1) of the wear bar (16). The locking bar and shell are provided with aligned bolt holes as shown at 20.6, threaded bolts being used as means to urge the locking bar into the slot and enabling the locking bar to be rigidly but removably held to the shell. It will be noted that the forward surface (20.1) of the locking bar is desirably coextensive with the forward or outer surfaces (14.2 and 16.5) of the slotted bar and wear bar, respectively, and as a result, the edge (20.7) of the locking bar adjacent its side wall (20.2) protrudes outwardly slightly from the circumferential surface (12.4) of the shell.

It is desired that the incisions made in a railroad tie or a similar workpiece be staggered somewhat; accordingly, the slots (14.1) formed in adjacent tooth-receiving bars (14) desirably are staggered longitudinally of the roller. For a roller having an outer diameter of about 15 inches (about 38 cm.) good results have been obtained by employing twenty longitudinal rows of teeth arranged equiangularly about the circumference of the roller and each containing about ten teeth spaced from one another typically by a distance of about three-fourths inches (19 mm.). The blade portion of the teeth may be on the order of 0.8 inches (20 mm.) in length and the pointed end of each tooth desirably is somewhat blunt with the edges of the blade being somewhat sharper. The outer shell, the tooth-receiving bar, the wear bar and the locking bar desirably are made of steel, and the teeth similarly are made of steel but desirably are hardened.

In use, it will be understood that the protruding edge (20.7) of the locking bar comes into contact with the workpiece, the bar thus being urged inwardly of the slot (12.5). The force thus generated causes the camming wall (20.4) of the locking bar to bear against the oblique side walls (18.5) of the teeth which are aligned in the slot, thereby locking the teeth firmly in position. In this manner, even if the locking bar should loosen slightly during operation, the teeth nonetheless are held rigidly in place. The locking bar in this manner furnishes locking means for locking the teeth within the sockets and for urging the teeth into a fixed, seated position in the sockets. In the event a tooth is broken, the locking bar engaging that tooth is removed by simply removing the bolts holding it to the shell. The remaining portion of the borken tooth can then be slipped outwardly of the socket and can be replaced by a new tooth. With reference particularly to FIG. 2, it will be noted that the base of the tooth has a portion (18.7) which is exposed when the locking bar is removed and which serves as a convenient handle for removing the base of a broken tooth from the slot (14.1). In this manner, teeth can be rapidly and easily replaced.

Manifestly, the present invention provides a toothed incisor roller in which the teeth are rigidly held in place and that enables individual teeth, when broken, to be easily replaced without disturbing other teeth.

While I have described a preferred embodiment of the present invention, it should be understood that various changes, adaptations, and modifications may be made therein without departing from the spirit of the invention and the scope of the appended claims.

I claim:

1. An incisor roll for incising a workpiece and comprising a cylinder rotatable about its axis and having a cylindrical outer surface provided with slots extending generally parallel to its axis, and socket means within each slot defining a row of spaced sockets extending longitudinally of each sot for the receptiion of incisor teeth;

a plurality of incisor teeth received in the sockets, each tooth having a base portion seated within a socket and a blade portion protruding outwardly of the cylindrical outer surface, the base portion of each tooth having a bearing surface, and the sockets being free of obstacles preventing removal of teeth individually therefrom; and locking means for firmly seating and locking the teeth within the sockets, the locking means including a plurality of elongated locking bars removeably attached to the cylinder and each extending along a row of teeth, each locking bar having a camming surface engaging the teeth in its respective row and urging the teeth into their respective sockets;

whereby removal of the locking means permits any tooth base portion of the plurality of teeth engaged by the camming surface to be individually removed and replaced without disturbing the remaining teeth.

2. The incisor roll of claim 1 in which the locking bars have exterior surfaces engageable with a workpiece as the latter is transported past an engagement with the cylinder to urge the camming surfaces of the locking bars inwardly against the bearing surfaces of the teeth.

3. The incisor roll of claim 1 in which the bearing surface of each tooth is defined by a side wall of that tooth, such side wall forming a given obtuse angle with a tangent drawn to the circumference of the cylinder where that side wall emerges from the cylindrical surface, the camming surface of the locking bar making a given acute angle with said tangent that is complementary to said obtuse angle.

4. An incisor roll for incising a workpiece and comprising a cylinder rotatable about its axis and having a cylindrical surface provided with slots therein extending generally parallel to its axis and spaced about its circumference;

socket means within each slot defining a row of spaced sockets extending longitudinally of each slot;

a plurality of incisor teeth each having a base portion received in a socket and a blade portion extending outwardly of the cylindrical surface, the base portion having a side forming a bearing surface at an obtuse angle with a tangent drawn to the cylindrical surface where said side emerges from the latter surface;

an elongated locking bar removably attached to the cylinder and received in each slot adjacent the respective row of sockets in that slot, the locking bar having a camming surface engaging the bearing surfaces of a plurality of said incisor teeth received in that repsective row of sockets; and means for urging the locking bars into the respective slots with the camming surfaces of the bars engaging the bearing surfaces of the teeth to rigidly seat the latter in their respective sockets.

5. An incisor roll for incising a workpiece and comprising a cylinder rotatable about its axis and having a plurality of spaced sockets in its circumferential surface;

incisor teeth removably seated in the sockets and protruding outwardly to incise a workpiece engaged by the cylinder as the latter rotates; and locking means for locking the teeth in the sockets and including camming means removably attached to the cylinder, the camming means including an exterior surface engageable with a workpiece as the latter is transported past and in engagement with the cylinder to urge the camming means inwardly of the cylinder, and a camming surface engageable with a plurality of said teeth and oriented to urge the latter teeth to seat rigidly in the sockets as the camming means is urged inwardly of the cylinder.

6. The incisor roll of claim 5 in which the sockets are arranged in rows generally parallel to the axis of the cylinder and spaced about the circumference of the cylinder, and wherein said locking means comprises a plurality of elongated locking bars each independently removably attached to the cylinder and each extending adjacent a row of incisor teeth, each locking bar having a camming surface engaging the teeth in its respective row and an exterior surface engageable with a workpiece as the latter engages the cylinder.

7. The incisor roll of claim 6 in which the incisor teeth have base portions with side walls, one side wall of each incisor tooth forming a given obtuse angle with a tangent drawn to the circumference of the circle where that side wall emerges from the cylindrical surface, the camming surface of the locking bar making a given acute angle with said tangent that is complementary to said obtuse angle.

8. The incisor roll of claim 6 in which the cylinder is provided with slots extending parallel to the rows of teeth and receptive of the respective locking bars, each slot having a generally radially extending guide wall and each locking bar having a side wall slideable against the guide wall of the slot as the locking bar is received in this slot, the plane defined by the side wall of the locking bar forming an acute angle with the plane defined by the camming surface of the locking bar.

* * * * *